United States Patent [19]

Adams et al.

[11] 4,045,335

[45] Aug. 30, 1977

[54] BENEFICIATION OF KIESERITE AND LANGBEINITE FROM A LANGBEINITE ORE

[75] Inventors: Ben E. Adams, Hanford, Calif.; Edward J. Gidak, Jr., Carlsbad, N. Mex.

[73] Assignee: Duval Corporation, Houston, Tex.

[21] Appl. No.: 665,419

[22] Filed: Mar. 10, 1976

[51] Int. Cl.[2] ..... B03D 1/02

[52] U.S. Cl. ..... 209/166

[58] Field of Search ..... 209/166, 167, 9; 423/155, 454

[56] References Cited

U.S. PATENT DOCUMENTS

| | | | |
|---|---|---|---|
| 2,702,121 | 2/1955 | Colin | 209/166 |
| 2,766,884 | 10/1956 | Marullo | 209/166 |
| 2,766,885 | 10/1956 | Marullo | 209/166 |
| 2,921,678 | 1/1960 | Fuchsman | 209/166 |
| 3,049,233 | 8/1962 | Marullo | 209/167 X |
| 3,447,681 | 6/1969 | Ramirez | 209/166 |

FOREIGN PATENT DOCUMENTS

| | | | |
|---|---|---|---|
| 871,133 | 3/1913 | Germany | 209/166 |
| 1,064,891 | 9/1959 | Germany | 209/166 |
| 1,144,213 | 10/1960 | Germany | 209/166 |

*Primary Examiner*—Robert Halper

*Attorney, Agent, or Firm*—Delmar L. Sroufe; Frank B. Pugsley; Alan D. Rosenthal

[57] ABSTRACT

Langbeinite and kieserite are beneficiated in a flotation process in which separation of ore particles is conducted in a froth flotation process with a magnesium chloride brine containing at least 20 moles $MgCl_2$ per 1000 mols $H_2O$. Said brine is maintained at a pH below about 3.5. The preferred flotation agent is a combination of a fatty acid amine (preferably tallow amine) and an organic acid, either oleic or sebacic acid, in an approximate ratio of 2 to 4 parts amine to 1 part oleic or sebacic acid, and preferably in an amine-oleic or amine-sebacic acid ratio of about 3:1. Flotation is preferably conducted in two stages wherein the sink product from the rougher flotation contains langbeinite above about 95% concentration which is relatively free of kieserite and the froth from the rougher flotation is passed to a second "cleaner" flotation step where the kieserite is further concentrated to above about 75% kieserite. The sink product from the cleaner flotation is recycled to the rougher flotation step for further processing with the pulp containing the incoming ore particles.

17 Claims, 4 Drawing Figures

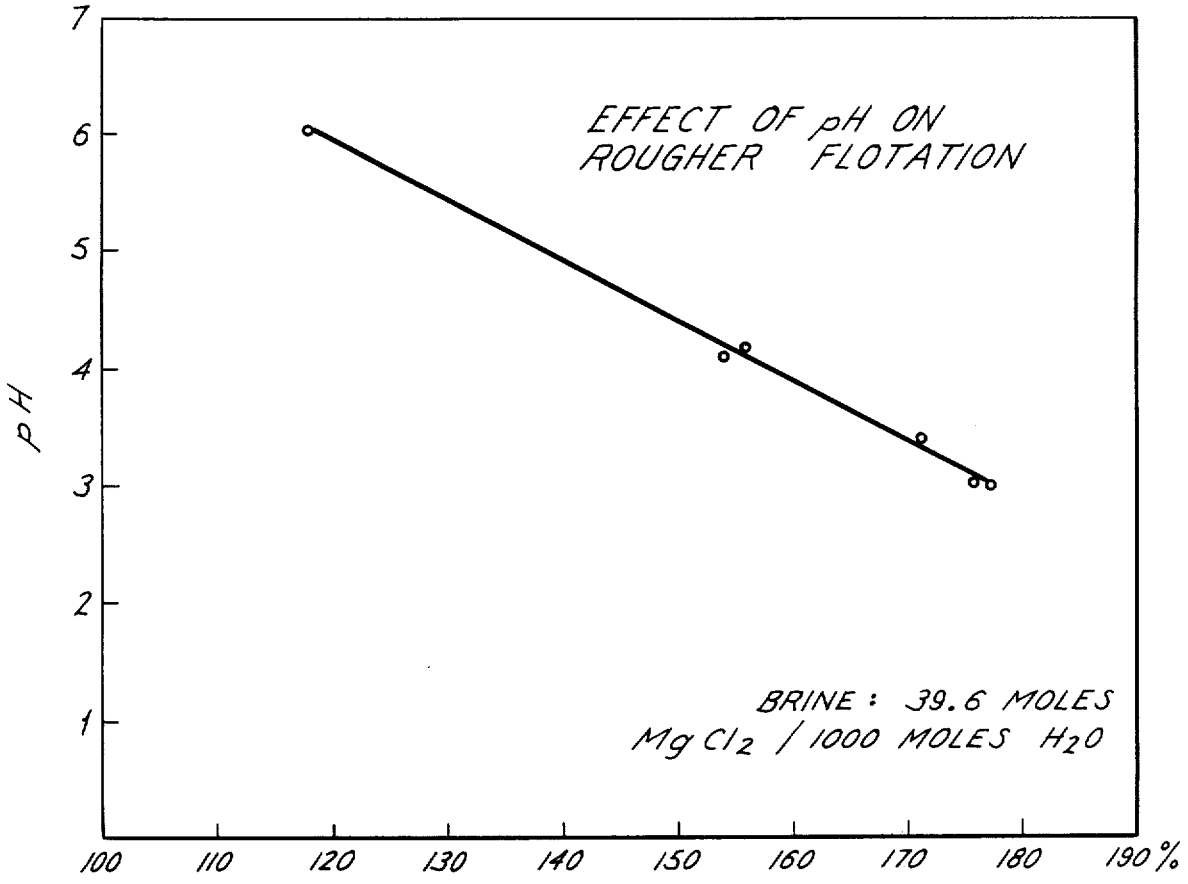
Fig. 2
Fig. 3
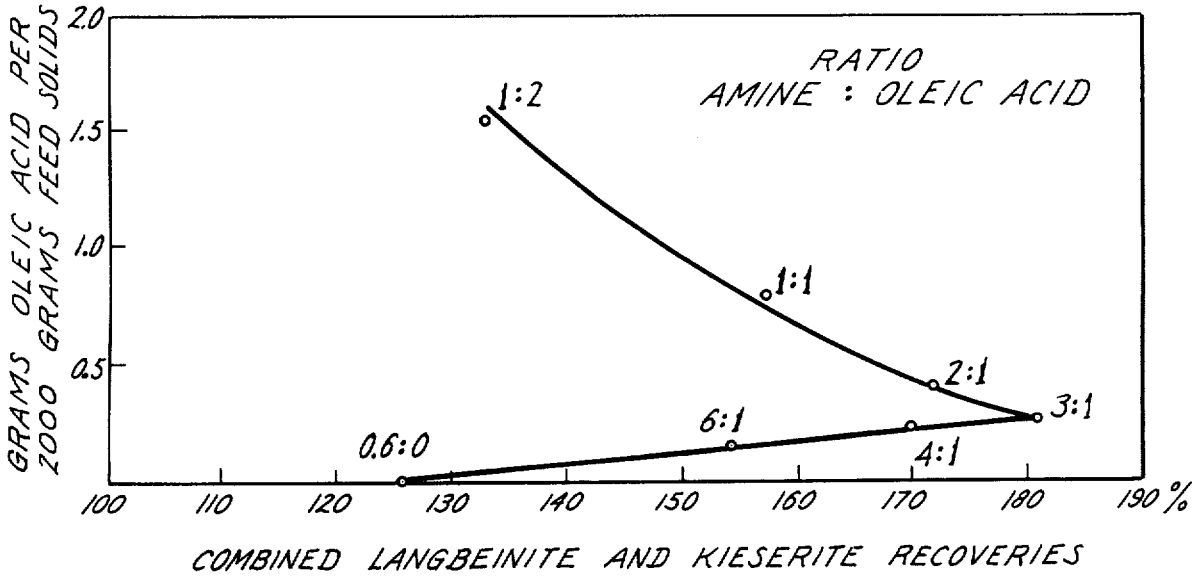

BENEFICIATION OF KIESERITE AND LANGBEINITE FROM A LANGBEINITE ORE

BACKGROUND OF THE INVENTION

A. Field of the Invention

The present invention relates to the beneficiation of langbeinite and kieserite contained in certain ores, such as langbeinite ore from the Carlsbad Basin in New Mexico containing kieserite in various quantities from about 2 to 35%. Langbeinite and kieserite are both used as fertilizer ingredients. Langbeinite ($K_2SO_4.2MgSO_4$) is desirable for this purpose because it provides a source of potassium, magnesium and sulfur. Kieserite ($MgSO_4.H_2O$) provides slowly water soluble magnesia which is useful for various purposes particularly as a fertilizer component. Langbeinite is customarily sold with a minimum guaranteed analysis of 22% $K_2O$ (97% langbeinite) and kieserite is currently marketed with a minimum guaranteed analysis of 26% MgO.

B. Prior Art

A number of processes have been developed for the concentration or beneficiation of kieserite. U.S. Pat. No. 3,480,139 discloses a method for the flotation of kieserite after an electrostatic separation, using fatty acid amines as flotation agents. A number of German patents have been directed to the separation of kieserite from various contaminants. DAS No. 871,133 (1953) discloses a process for the flotation of kieserite containing potassium salts, using aliphatic amine and a magnesium sulfate carrier liquor. DAS No. 1,064,891 (1959) relates to the separation of kieserite from anhydrite (anhydrous calcium sulfate) using an unsaturated brine carrier liquor at a pH not above 6.8.

German Pat. DAS No. 1,144,213 (1963) teaches the use of amines and oleic acid in a 6:1 ratio for the flotation of kieserite in a water medium for the separation of kieserite from sylvinite ores.

German Pat. DAS No. 1,159,871 (1963) teaches the flotation of various mixtures of kieserite, langbeinite and anhydrite and says that the separation of kieserite from langbeinite is possible with pH values around the neutral point PH 7.0. The process requires low electrolyte liquors or water as the carrier liquor and fatty acid amines were used as the flotation agent. The process produced langbeinite of only 87% concentration.

SUMMARY OF THE INVENTION

Most of the prior art processes cannot be used to separate langbeinite and kieserite. The process of German Pat. DAS No. 1,159,871 requires large quantities of water and the carrier liquor must be dumped when the concentration of electrolytes is increased during use. Moreover, the German process does not produce langbeinite of sufficient concentration to provide a minimum of 22.0% $K_2O$ as customarily required for use in most fertilizer formulations in North America.

It is the discovery of the present invention that langbeinite and kieserite may be separated and both minerals may be individually concentrated by a flotation process in which the pulp containing ore particles is prepared with a magnesium chloride brine maintained at a pH below about 3.5 and preferably below about 3.3. It has been found that commercially satisfactory yields of both products can be obtained by employing as a flotation agent a fatty acid amine (preferably tallow amine acetate) and oleic or sebacic acid in an approximate ratio of 2 to 4 parts amine to 1 part oleic or sebacic acid, and preferably at a ratio of about 3 to 1 amine to oleic or sebacic acid.

It is preferred that the flotation be conducted in two stages wherein concentrated langbeinite is obtained from the sink product of the rougher flotation stage and the froth from the rougher flotation is passed to a second flotation stage where the kieserite is further concentrated in the froth product. The mids or sink from the cleaner flotation is recycled to the first flotation stage for further processing with the pulp containing the incoming ore particles.

In the present process, magnesium chloride brine is used in the preparation of the pulp for the flotation process and it has been found that a minimum concentration of about 20 moles magnesium chloride per 1000 moles water is necessary to obtain sufficiently high yields for efficient operation of the process. It is preferred that concentrations above about 35 moles per 1000 moles of water be used. The brine may be reused repeatedly with occasional additions of magnesium chloride to maintain the concentration at the desired level.

In a single flotation stage, a sink product of langbeinite above about 95% concentration and relatively free of kieserite may be obtained by the present process. The froth from such single stage contains concentrated kieserite; however, in order to obtain the concentrations of kieserite desired for most industrial and fertilizer use, the froth from the first flotation stage is preferably subjected to a further flotation procedure to reduce the percent $K_2O$ below about 2.5%.

BRIEF DESCRIPTION OF THE DRAWINGS

FIG. 2 is a graph showing the effect of pH on the rougher flotation.

FIG. 3 is a graph showing the effect of variations in the amine:oleic acid ratio upon the combined langbeinite and kieserite recovery in the rougher flotation.

DESCRIPTION OF THE PREFERRED EMBODIMENTS

Figure 1:
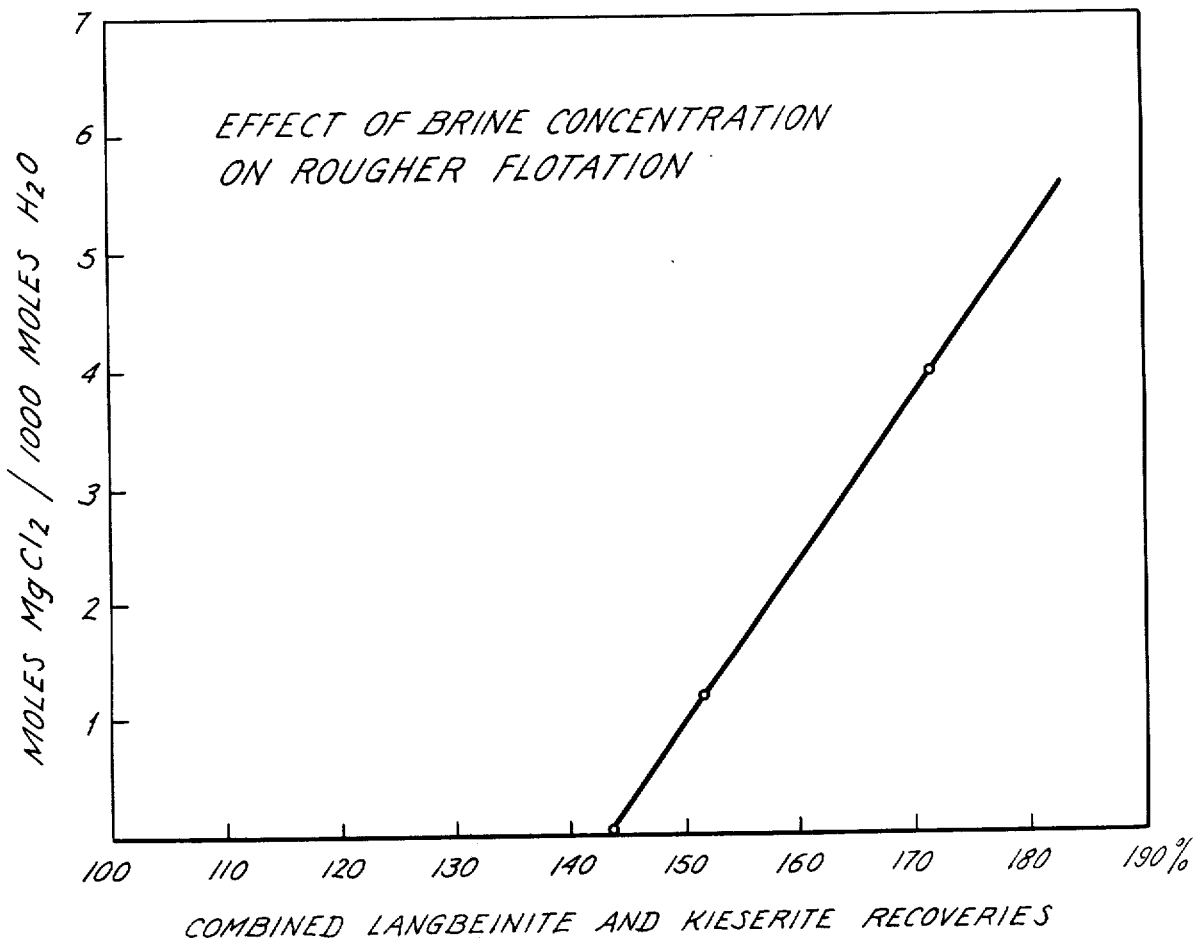
FIG. 1 is a drawing showing the effect of brine concentration on the combined recovery of langbeinite and kieserite on the rougher flotation.

To obtain concentrates of langbeinite and kieserite from ore containing these minerals, separation is achieved in a conventional flotation cell. Any suitable commercial flotation cell may be used, such as the Denver Sub-A, the Agitair cell (U.S. Pat. No. 2,182,442), and other flotation cells known in the art.

In the flotation cell, the pulp is subjected to mechanical agitation and/or aeration whereby a froth is formed which carries the kieserite particles to the surface. The froth containing suspended solids is removed as overflow from the flotation cell.

As previously stated, flotation is conducted upon ore particles in a magnesium chloride brine. Such brine at a concentration of about 45–55 moles $MgCl_2$ per 1000 moles water may be available as a waste product from plants processing potassium sulfate. If waste brine is not available a suitable brine may be prepared by dissolving $MgCl_2$ in water in the desired quantities. It has been found that the magnesium chloride content of such brine is the only significant factor and that magnesium chloride brines may be used in the present process so long as the pH is maintained below about 3.5. Moreover, the magnesium chloride brine may be reused repeatedly with additional makeup of magnesium chloride (by the addition of $MgCl_2$ or the addition of concentrated brine) from time to time as required to maintain the magnesium chloride concentration above about 20 moles magnesium chloride per 1000 moles water preferably above about 35 moles magnesium chloride per 1000 moles of water. If sulfate plant evaporator waste liquor containing concentrated $MgCl_2$ is available it may be used. Such brine has a pH normally between about 2.8 and 3.3; however, the pH of the brine or recycled brine may be adjusted to reduce it below 3.5 or preferably below 3.3 by the addition of any suitable acid such as sulfuric or hydrochloric acid. Hydrochloric acid is presently preferred for this purpose.

As a flotation reagent, it has been found that a combination of an amine and oleic acid, $C_8H_{17}CH{:}CH(CH_2)_7COOH$, or a combination of an amine and sebacic acid, $HOCO(CH_2)_8COOH$, in a ratio ranging from about 4:1 to about 2:1 amine to oleic or sebacic acid and preferably about 3:1 is desirable to obtain combined recoveries of langbeinite and kieserite needed for efficient commercial operations.

The presently preferred fatty acid amine used in this flotation reagent is an amine acetate formed from tallow amine having from about 16 to about 18 carbon atoms in a chain. The amine acetate formed by neutralization of the tallow amine acetate is available and in common use in flotation processes. It is available in various grades and it has been found that, for example, tallow amine and tallow distilled amine may be used in the present process with equal results. Other fatty acid amines may be used in the practice of the present invention, including dodecylaminehydrochloride, dodecylamine-acetate, stearyl amine-hydrochloride, stearylamine-acetate and palmitic amine-acetate.

The oleic or sebacic organic acid component of the dual component flotation agent may be conveniently added in the form of an alcohol solution (20 parts alcohol to 1 part oleic or sebacic acid) and the amine may be added as a 3% aqueous solution, however, the ratio of amine to oleic or sebacic acid is determined on the basis of the weights of the amine and oleic or sebacic acid. The amount of the flotation agent or collector may be as little as about ½ pound to as much as 5 pounds collector per ton of feed; however, for satisfactory yields it has been found that in the processing of most ores about 1 pound per ton of feed is required and, generally amounts in excess of about 1 to 2 pounds per ton do not produce additional yield and are therefore wasteful.

The high kieseritic ore which is encountered in the Carlsbad Basin area has a varying analysis from which the following mineral ranges are typical:

| | |
|---|---|
| langbeinite | 27.9% -40.3% |
| kieserite | 7.5%-27.4% |
| polyhalite | 0.2% - 1.96% |
| KCl | 6.5% -11.1% |
| NaCl | 21.1% -47.15% |
| insoluble | 2.6% - 4.7% |

In order to effect separation of the langbeinite and kieserite in the present process it is necessary that the ore be crushed or comminuted to a particle size suitable for froth flotation. The crushing or comminution of the ore may be accomplished with any suitable type of grinding or crushing apparatus, such as, for example, an impactor, hammer mill, rod mill, ball mill, roller mill, etc. Such crushing or grinding may be used to produce an ore size of − 8 mesh or preferably −20 mesh for froth flotation.

In a preferred procedure, the ore may be initially crushed to −4 mesh size and the desired −8 mesh or preferably −20 mesh size particles may be separated from the larger size particles by screening with a suitable sizing screen.

The comminuted ore is leached with water by flushing and draining to remove most of the sodium chloride and clay slimes associated with the ore.

In an alternate grinding and leaching procedure the −4 mesh ore from the grinding step is leached and then dried in an oven at 350° to 425° F. and the dried cake crushed to −6 mesh and separated into granular (+20 mesh) and standard (−20 mesh) fractions. The granular fraction may be analyzed for its $K_2O$ content and sold in accordance with its analysis as a langbeinite concentrate or it may be blended with concentrated langbeinite from the flotation process of this invention. The standard fraction may be used as the flotation feed for the flotation process.

FIGS. 1, 2 and 3 illustrate the effect of several variables upon the total kieserite plus langbeinite recovery from an ore containing about 36% langbeinite and about 7.5% kieserite. To prepare the ore for flotation testing, it was crushed to −4 mesh and leached with agitation for about 45–60 seconds in water and drained to approximate the conventional leaching and desliming in plant operations.

The leached langbeinite/kieserite was then dried in an oven at 350° to 425° F. and the dried cake was crushed to −6 mesh and separated into +20 mesh (granular) and −20 mesh (standard) fractions. The granular fraction was analyzed and discarded. The standard fraction then became the feed ore for test purposes. In all laboratory tests a 6000 gram sample was mixed with a carrier liquid to form a thick pulp of about 50% solids. The pulp was agitated for one minute and conditioned with 0.03 - 0.15 gms (net weight) guar gum (0.01 - 0.05 gms per 2000 gms feed solids) added as a 0.35% aqueous solution, and after 1 minute additional agitation, 3 grams of a flotation agent was added (1 gram of agent per 2000 grams of the particulate feed solids).

Except as otherwise specified in the data set forth hereinafter, the flotation agent was added to the pulp by the separate addition of 0.75 grams net weight tallow amine acetate (in a 3% aqueous solution) for each 2,000 grams of the feed sample solids, and then 0.25 grams net weight oleic or sebacic acid in the form of an alcohol solution (20 parts alcohol or 1 part oleic or sebacic acid) was added for each 2,000 grams of feed sample solids. Hexanol (frother) was added in an amount of 10 drops for the 6,000 gram samples used in the laboratory flotation test (about 0.015 grams/2000 grams of feed solids).

A series of single-stage flotation tests was conducted which established the increased concentration of langbeinite in the sink product and the increased concentration of kieserite in the froth product. Also in this series of tests the comparable results of the use of oleic and sebacic acid was demonstrated. The feed ore containing langbeinite and kieserite was crushed, conditioned and screened as described above. The test results are illustrated in Table A below in which the carrier liquid was magnesium chloride brine containing 39.6 mols magnesium chloride per 1,000 mols water and in which the pH was adjusted by the addition of sodium hydroxide in hydrochloric acid to obtain a pH value of 3.1. Quantities of reagents are given as the net weight of the reagent added in grams per 2,000 grams of feed sample solids.

TABLE A

ROUGHER FLOTATION TESTS (SINGLE-STAGE)

| Sample | % Lang. | % Kies. | REAGENTS Guar | Amine | Oleic Acid | Sebacic Acid | Frother |
|---|---|---|---|---|---|---|---|
| Float | 60.46 | 16.51 | 0.01 | 0.57 | 0.3 | — | 0.015 |
| Sink | 85.56 | 13.72 | | | | | |
| Float | 32.48 | 30.79 | 0.01 | 0.57 | 0.3 | — | 0.015 |
| Sink | 88.00 | 9.45 | | | | | |
| Float | 29.19 | 51.91 | 0.01 | 0.57 | — | 0.3 | 0.015 |
| Sink | 91.25 | 6.26 | | | | | |
| Float | 46.23 | 38.36 | 0.01 | 0.57 | — | 0.3 | 0.015 |
| Sink | 86.99 | 10.07 | | | | | |

In further tests of the use of amine-sebacic acid as the flotation agent, the langbeinite and kieserite recovery was determined as shown in Table B. As previously indicated, quantities of reagents are given as the net weight of the reagent in grams per 2,000 grams of feed sample solids.

TABLE B

ROUGHER FLOTATION TESTS WITH SEBACIC ACID

| Sample | % Lang. | % Lang. Recovery | % Kies. | % Kies. Recovery | Combined Recoveries | REAGENT Guar | Amine | Sebacic Acid | Frother |
|---|---|---|---|---|---|---|---|---|---|
| Float | 11.9 | | 81.3 | 54.7 | 149.4 | 0.05 | 0.43 | 0.33 | 0.015 |
| Sink | 72.3 | 94.7 | 23.1 | | | | | | |
| Float | 14.1 | | 79.4 | 55.8 | 148.5 | 0.05 | 0.43 | 0.33 | 0.015 |
| Sink | 70.9 | 92.7 | 24.8 | | | | | | |

The effect of magnesium chloride concentration in the brine is illustrated in the combined kieserite and langbeinite recovery from a single stage (rougher) flotation step upon the langbeinite/kieserite ore material prepared as described above. The results are illustrated in Table I below in which the liquid or brine was in each instance maintained at 3.1 pH.

TABLE I

| Moles $MgCl_2$/1000 $H_2O$ | Kieserite Plus Langbeinite Recovery |
|---|---|
| 0.0 | 143.7% |
| 11.6 | 151.5% |
| 39.6 | 171.2% |

The effect of magnesium chloride brine concentration is further shown in the graphical presentation of the data of Table I in FIG. 1 of the drawings.

Further single-stage tests of a laboratory specimen of the langbeinite/kieserite material prepared and conditioned as described above was conducted, using a magnesium chloride brine containing 39.6 moles magnesium chloride per 1000 moles water in which the pH was adjusted by the addition of sodium hydroxide and/or hydrochloric acid to obtain the desired pH value. Recoveries from a single-stage flotation step are given below in Table II and are presented graphically in FIG. 2 of the drawings.

TABLE II

| pH of Brine | Kieserite Plus Langbeinite Recovery |
|---|---|
| 6.0 | 117.5 |
| 4.1 | 153.9 |
| 4.15 | 155.5 |
| 3.4 | 171.0 |
| 3.0 | 175.5 |
| 3.0 | 177.2 |

The effect of the ratio of amino:oleic or amine sebacic acid upon the combined recovery of kieserite and langbeinite (based upon the percentage of each recovered from the feed ore) from a single stage flotation step was determined by conducting a series of tests in which a neutralized 3% aqueous amine solution was added in various proportions with respect to oleic or sebacic acid which was preferably added in the form of an alcohol solution (20 parts alcohol to 1 part oleic or sebacic acid). Surprisingly, it was found that the ratio of amine to the oleic or sebacic acid has a great bearing on the combined recoveries of langbeinite and kieserite. In a series of single-stage flotation tests using the specimens of the ore prepared and conditioned as previously described but varying the flotation agent as indicated in Table III, the results are as follows:

TABLE III

| Gms Oleic Acid* Per Gram Ton Feed Solids | Gms Tallow Amine Acetate Per Gram Ton Feed Solids | Amine:Oleic Ratio | Kieserite Plus Langbeinite Recovery |
|---|---|---|---|
| 0.76 | 0.00 | | 111% |
| 0.00 | 0.60 | | 125.9% |
| 0.14 | 0.84 | 6:1 | 154.3% |
| 0.20 | 0.80 | 4:1 | 170% |
| 0.25 | 0.75 | 3:1 | 181% |
| 0.40 | 0.80 | 2:1 | 172% |
| 0.78 | 0.78 | 1:1 | 157.1% |
| 1.55 | 0.78 | 1:2 | 133.0% |

*Comparable results were achieved with the use of sebacic acid.

Further tests were conducted upon the above described ore specimens prepared and conditioned a heretofore set forth, using a 3:1 ratio of amine:oleic acid in an amount of 1 gram per gram ton feed solids in a magnesium chloride concentration of 39.6 moles magnesium chloride per 1000 moles water, maintained at a pH of 3.1, tests of the sink and float products from a rougher flotation indicate that the froth product produces a kieserite contaminated with langbeinite while the sink is relatively free of kieserite. This is illustrated in Table IV below:

TABLE IV

| Percent $K_2O$ Feed | Percent $K_2O$ Sink |
|---|---|
| 18.9% | 22.2% |
| 18.7% | 22.1% |
| 16.6% | 22.4% |
| 16.5% | 22.4% |

TABLE IV-continued

| Percent $K_2O$ Feed | Percent $K_2O$ Sink |
|---|---|
| 18.0% | 22.0% |

In contrast to the above table, the froth was always contaminated with varying amounts of langbeinite. The following table gives examples of the rougher froth when compared to the above sinks:

TABLE V

| Percent $K_2O$ Froth | Percent $K_2O$ Sink |
|---|---|
| 13.7% | 22.2% |
| 9.6% | 22.1% |
| 9.0% | 22.4% |
| 9.2% | 22.4% |
| 10.3% | 22.0% |

When a cleaner flotation is performed on the rougher froth, the froth is well within the limits for the guaranteed minimum MgO for kieserite currently being marketed in the United States (26% MgO minimum). Three examples of the cleaner froth are given below:

TABLE VI

| Percent $K_2O$ Cleaner Froth | Percent MgO Cleaner Froth |
|---|---|
| 1.5% | 26.6% |
| 0.9% | 27.2% |
| 2.2% | 26.3% |

The foregoing discussion has been based on 75 separate flotation tests, and 375 analytical laboratory results, to determine the parameters of a kieserite/langbeinite flotation. In order to determine the feasibility of this process, a series was run on the entire process using the ore of the tests in Tables I through VI.

STEP 1 - Crushing to −4 mesh

| | |
|---|---|
| Langbeinite | 36.13% |
| Kieserite | 7.51% |
| NaCl | 47.15% |
| KCl | 3.88% |
| Water Insol. | 3.37% |
| Polyhalite | 1.96% |

STEP 2 - Leaching, Drying, Screening

| MINERAL | SCREENING FRACTIONS +8 | −8+14 | −14+20 | −20 |
|---|---|---|---|---|
| Polyhalite | 0.22% | 0.22% | 0.22% | 1.48% |
| Langbeinite | 98.41% | 98.68% | 98.41% | 88.50% |
| Kieserite | 0.09% | 0.00% | 0.03% | 8.25% |
| NaCl | 0.91% | 0.77% | 1.01% | 0.61% |
| Water Insol. | 0.37% | 0.33% | 0.33% | 1.16% |
| $K_2O$ | 22.34% | 22.40% | 22.34% | 20.09% |

Note:
In the above, the −20 mesh fraction was used as the flotation feed.

STEP 3 — Granular Langbeinite

Our testing has shown that granular langbeinite may be separated in the drying/screening step, if the leached ore is heated above 400° F. The granular langbeinite separated in Step 2 as the +20 mesh fraction would have the following analysis:

$K_2O$ — 22.36%
$M_gO$ — 19.24%
Cl — 0.61%

STEP 4 — Conditioning

Taking the minus 20 mesh from the leach Step 2 and feeding it to a conditioning step, as previously outlined a brine was prepared by mixing 50% Water/50% conc. $MgCl_2$ to obtain approximately 24 moles $MgCl_2$/1000 moles water in the resulting brine. A sample weighting 6000 grams was conditioned at 50% solids in a Denver attrition agitator, as follows:

1. agitation for 1 minute
2. add 0.05 gms guar gum/gm ton feed solids
3. agitation for 1 minute
4. add 0.43 gms amine acetate/gm ton feed solids
5. agitation for 1 minute
6. add 0.14 gms oleic or sebacic acid/gm ton free solids (3:1 ratio amine:oleic or sebacic)
7. agitation for 1 minute
8. add approximately 0.015 gms hexyl alcohol per gram ton of feed solids as a frother
9. transfer to flotation cell.

STEP 5 — Flotation (rougher)

Analysis of flotation brine added for 25% solids:

| moles/1000 | moles $H_2O$ |
|---|---|
| $MgSo_4$ | 12.5 |
| $MgCl_2$ | 53.1 |
| $K_2Cl_2$ | 8.1 |
| $Na_2Cl_2$ | 7.4 |
| $H_2O$ | 67.8 |
| pH | 3.1 |

Rougher sink — standard langbeinite analysis (using oleic acid)

| MINERALS | PERCENT |
|---|---|
| Polyhalite | 0.83% |
| Langbeinite | 96.52% |
| Kieserite | 2.05% |
| Water Insoluble | 0.60% |
| $K_2O$ | 22.04% |
| MgO | 18.80% |

The "tails" of this float is referred to as sink, since this material is a marketable product. In plant operation this would be passed to a centrifuge and dryer for commercial langbeinite production.

STEP 6 — Flotation (cleaner) Using Oleic Acid

The froth from the rougher float was collected and "refloated" without additional conditioning or reagents.

| MINERALS: | FLOAT: | MIDDLINGS: |
|---|---|---|
| Polyhalite | 2.26% | 3.54% |
| Langbeinite | 16.02% | 78.66% |
| Kieserite | 80.53% | 12.12% |
| Water Insoluble | 1.19% | 5.68% |
| $K_2O$ | 3.64% | 18.41% |
| MgO | 26.70% | 19.39% |

Kieserite is customarily marketed without a size grade. Therefore, the cleaner froth may be dewatered and dried without the usual screening step before warehousing. The middlings (sink) from the cleaner flotation may be recycled in commercial operations to the rougher flotation feed.

Figure 4:
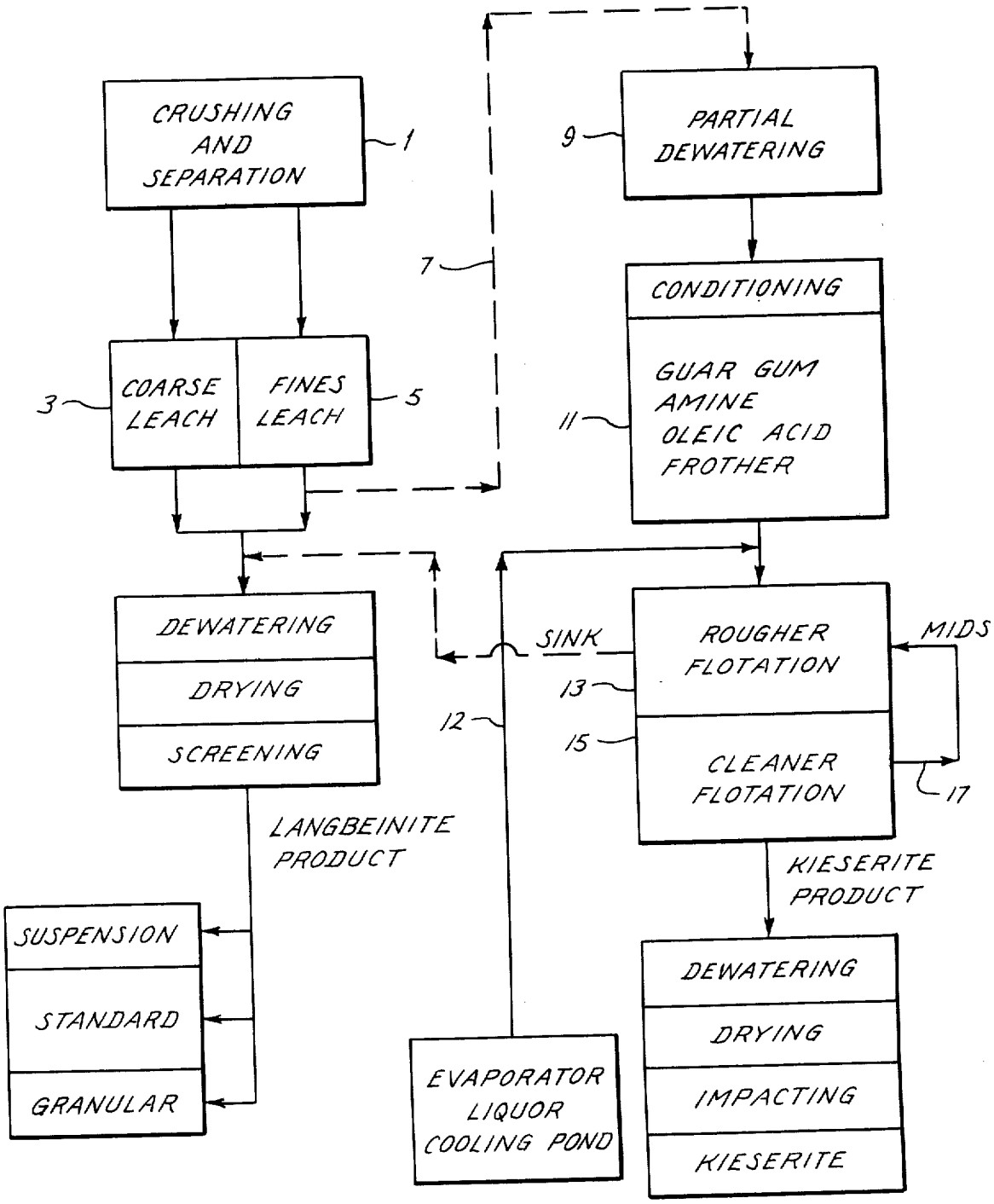
FIG. 4 is a schematic flow diagram illustrating an embodiment of the invention.

Referring now to FIG. 4, a commercial embodiment of the present invention is illustrated by a flow diagram in which the mine run ore is subjected to a preliminary crushing and screening separation 1. The course particles sized above the size desired for froth flotation are passed to the coarse leach 3.

Fines from the sizing screen having a particle size within the desired range for froth flotation (preferably −20 mesh) are passed to the fines leach 5. In the coarse and fines leaching step the particles are washed and flushed to remove sodium chloride and the major portion of the clay slimes associated with the incoming ore. The ore from the fines leach is passed by conveyor 7 to a partial dewatering step where the particles are drained or otherwise processed to remove surface water prior to conditioning.

The dewatered feed ore is then passed to the conditioning step 11 where a brine containing about 22–25 moles magnesium chloride is admixed with the langbeinite-kieserite containing solids in an amount sufficient to form a thick pulp, usually from about 50 to about 75%, preferably about 50%, solids content. During conditioning, the ore is agitated in the brine/water mixture and the conditioning reagents are added. The sequence of addition of the reagents is unimportant other than the addition of guar which should be added initially for slime control.

A suitable conditioning procedure is as follows:

1. Agitation for 1 minute;
2. Add 0.05 pounds of guar gum per ton of feed solids as a slime controllant;
3. Agitation for 1 minute;
4. Add 0.43 pounds amine acetate per ton feed solids;
5. Agitation for 1 minute;
6. Add 0.14 pounds oleic or sebacic acid per ton feed solids (3:1 ratio amine:oleic or sebacic acid);
7. Agitation for 1 minute;
8. Add approximately 0.015 pounds hexyl alcohol per ton feed as a frother.

Various slime control agents other than guar gum may be used, such as, for example starch and polyglycol ethers.

During the conditioning stage of the process, as indicated above, a frothing agent is customarily incorporated in the pulp. Suitable frothing agents are known and described in the art. Alphatic alcohols of intermediate molecular weight (about $C_4$–$C_{10}$), methyl isobutyl carbinol, soap, and pine oil are commonly used for this purpose; however, hexanol is presently preferred as a frothing agent in the practice of this invention.

The amount of the frothing agent needed for effective flotation may vary over fairly wide limits, depending upon the condition of the feed and other operating variables. Such frothers are generally employed in amounts of between 0.01 and about 1 pound per ton, preferably about 0.01–0.03 pound per ton, of the ore solids being processed.

After conditioning the ore, the slurry is diluted by the addition, through line 12, of a magnesium chloride brine containing about 45–50 mols magnesium chloride brine per 1000 mols of water to produce the desired particle concentration between about 20 and about 30% solids, and preferably about 25% solids. The diluted pulp is then passed to the rougher flotation cell 13 for the first stage of froth flotation.

From the rougher flotation cell 13, the froth product contains a kieserite contaminated with langbeinite while the sink is relatively free of kieserite. The sink product from the rougher flotation cell is dewatered, dried and prepared in any desired manner for marketing.

The froth from the rougher float is collected and refloated in the cleaner flotation cell 15 without additional conditioning or reagents. The underflow or "mids" from the cleaner flotation is returned by conduit 17 to the rougher flotation cell. The froth product contains kieserite in concentrations suitable for commercial use. When the cleaner froth is dewatered, dried and prepared for marketing as may be desired the resulting product contains a minimum of about 75% kieserite.

I claim:

1. A process for beneficiating langbeinite from an ore containing langbeinite and kieserite which comprises subjecting to froth flotation particles of said ore in an aqueous magnesium chloride brine containing above about 20 moles magnesium chloride per 1,000 moles of water, said brine containing a flotation reagent in a ratio of at least about 0.5 parts by weight flotation reagent to 2000 parts by weight of said ore particles, said flotation reagent comprising a fatty acid amine, and an organic acid selected from the group consisting of sebacic acid and oleic acid in a weight ratio of about 2 to about 4 parts amine to 1 part of said organic acid, said brine further having a pH below about 3.5, removing the froth from said flotation, and recovering concentrated langbeinite from the sink product of said flotation.

2. The process of claim 1 in which the pH of said brine is between about 2.8 and about 3.3.

3. The process of claim 1 in which pH of said brine is about 3.1.

4. The process of claim 1 in which the amine:organic acid ratio is about 3:1.

5. The process of claim 1 in which amine is tallow amine.

6. The process of claim 1 in which said organic acid is oleic acid.

7. The process of claim 1 in which said organic acid is sebacic acid.

8. The process of claim 1 in which said concentration of magnesium chloride brine is above about 35 moles magnesium chloride per 1000 moles water.

9. A process for beneficiating an ore containing langbeinite and kieserite which comprises subjecting to froth flotation a pulp comprising particles of said ore in an aqueous magnesium chloride brine containing above about 20 moles magnesium chloride per 1,000 moles of water, said brine containing a flotation reagent in a ratio of at least about 0.5 parts by weight of flotation reagent to 2000 parts by weight of said ore particles, said flotation reagent comprises a fatty acid amine and an organic acid selected from the group consisting of oleic acid and sebacic acid in a ratio of about 2 to about 4 parts amine to 1 part organic acid, said brine further being maintained at a pH below about 3.5, removing the froth from said flotation, subjecting said froth from said flotation to a second flotation stage, recovering concentrated kieserite from the froth from said second flotation stage and conveying the sink product therefrom into said pulp.

10. The process of claim 9 in which the amine: organic acid ratio is about 3:1.

11. The process of claim 9 in which the pH of said brine is between about 2.8 and about 3.3.

12. The process of claim 9 in which the pH of said brine is about 3.1.

13. The process of claim 9 in which the fatty acid amine:organic acid ratio is about 3:1.

14. The process of claim 9 in which said fatty acid amine is tallow amine acetate.

15. The process of claim 9 wherein said organic acid is oleic acid.

16. The process of claim 9 wherein said organic acid is sebacic acid.

17. The process of claim 9 in which said concentration of magnesium chloride brine is above about 35 moles magnesium chloride per 1000 moles water.

* * * * *